US011274445B2

(12) United States Patent
Gu et al.

(10) Patent No.: US 11,274,445 B2
(45) Date of Patent: Mar. 15, 2022

(54) HIGHLY INTEGRATED CONCRETE SLAB STRUCTURE FULL OF CAVITIES AND HAVING STABLE AND SUPERIOR PERFORMANCE, CAVITY STRUCTURE AND STEEL REINFORCED FRAMEWORK STRUCTURE

(71) Applicant: NANJING SHENGYUAN CIVIL ENGINEERING HIGH TECHNOLOGY CO., LTD., Nanjing (CN)

(72) Inventors: Ruinan Gu, Nanjing (CN); Yizhong Gu, Nanjing (CN)

(73) Assignee: NANJING SHENGYUAN CIVIL ENGINEERING HIGH TECHNOLOGY CO., LTD, Nanjing (CN)

( * ) Notice: Subject to any disclaimer, the term of this patent is extended or adjusted under 35 U.S.C. 154(b) by 0 days.

(21) Appl. No.: 16/764,712

(22) PCT Filed: Jun. 20, 2018

(86) PCT No.: PCT/CN2018/091933
§ 371 (c)(1),
(2) Date: May 15, 2020

(87) PCT Pub. No.: WO2019/095687
PCT Pub. Date: May 23, 2019

(65) Prior Publication Data

US 2021/0123239 A1 Apr. 29, 2021

(30) Foreign Application Priority Data

Nov. 16, 2017 (CN) ..... 201711135173.4
Nov. 16, 2017 (CN) ..... 201721529444.X

(51) Int. Cl.
*E04C 2/24* (2006.01)
*E04C 2/34* (2006.01)

(52) U.S. Cl.
CPC ..... *E04C 2/24* (2013.01); *E04C 2/34* (2013.01); *E04C 2002/3477* (2013.01); *E04C 2002/3488* (2013.01)

(58) Field of Classification Search
USPC ..... 52/223.7, 223.5, 285.2, 293.3, 431, 600
See application file for complete search history.

(56) References Cited

U.S. PATENT DOCUMENTS 3,982,368 A * 9/1976 Perrin ..... E04B 2/842 52/381
4,001,474 A * 1/1977 Hereth ..... B32B 3/12 428/116

(Continued)

FOREIGN PATENT DOCUMENTS

CN 1779124 A 5/2006
CN 101042018 A 9/2007

(Continued)

OTHER PUBLICATIONS

International Search Report issued in corresponding International Application No. PCT/CN2018/091933, dated Sep. 5, 2018, pp. 1-8, State Intellectual Property Office of the P.R. China, Beijing, China.

(Continued)

*Primary Examiner* — Joshua K Ihezie
(74) *Attorney, Agent, or Firm* — Hauptman Ham, LLP

(57) ABSTRACT

The present invention relates to a full-cavity concrete slab structure with high integrity and stability and excellent performance, a cavity structure, and a steel bar framework. The slab type concrete structure is internally provided with a slab type concrete structure unit. An external concrete shell of the slab type concrete structure unit is internally provided with oblique concrete partitions. Both ends of the external concrete shell are sealed. Two side panels of the external (Continued)

concrete shell form enclosed air cavities together with the corresponding oblique concrete partitions and the sealed ends at the both ends. The air cavities are arranged in continuous rows in a staggered manner. The steel bar framework is provided in the external concrete shell and the oblique concrete partitions. The present invention implements high integration of energy saving and environmental protection of structures and buildings. The slab structure not only satisfies the load-bearing resistance requirements of an original wall structure, but also makes the structure safer and more earthquake-resistant and disaster-proof, namely, the self-safety, self-energy saving, and self-environmental protection of the structure are fully achieved. The slab structure needs neither an exterior veneer and an interior veneer, nor materials such as middle embedded thermal-insulation and fireproof materials, and can be applied as a variety of concrete slab structures for buildings, and thus the product has a wide range of applications.

9 Claims, 4 Drawing Sheets

(56) References Cited

U.S. PATENT DOCUMENTS

| | | | | | |
|---|---|---|---|---|---|
| 4,223,053 | A * | 9/1980 | Brogan | B29D 24/008 | 428/34.5 |
| 4,614,013 | A * | 9/1986 | Stevenson | B21F 27/128 | 140/112 |
| 5,372,868 | A * | 12/1994 | Prewo | E04C 2/34 | 428/120 |
| 5,501,055 | A * | 3/1996 | Storch | E04C 2/06 | 264/333 |
| 8,893,447 | B1 * | 11/2014 | Harris | E04C 5/162 | 52/223.7 |
| 2008/0260474 | A1 * | 10/2008 | Koster | E04C 1/395 | 405/284 |
| 2013/0266793 | A1 * | 10/2013 | Robertshaw | E04B 2/845 | 428/223 |
| 2017/0051506 | A1 * | 2/2017 | An | E04F 15/18 | |
| 2018/0023286 | A1 * | 1/2018 | Allen | B23K 20/127 | 52/588.1 |

FOREIGN PATENT DOCUMENTS

| | | | |
|---|---|---|---|
| CN | 101487313 | A | 7/2009 |
| CN | 201495679 | U | 6/2010 |
| CN | 204401865 | U | 6/2015 |
| CN | 205189252 | U | 4/2016 |
| DE | 202011000359 | U1 | 7/2012 |
| DE | 102015110129 | A1 | 12/2016 |

OTHER PUBLICATIONS

Written Opinion of the International Searching Authority issued in corresponding International Application No. PCT/CN2018/091933, dated Sep. 5, 2018, pp. 1-6, National Intellectual Property Office of the P.R. China, Beijing, China.

* cited by examiner

HIGHLY INTEGRATED CONCRETE SLAB STRUCTURE FULL OF CAVITIES AND HAVING STABLE AND SUPERIOR PERFORMANCE, CAVITY STRUCTURE AND STEEL REINFORCED FRAMEWORK STRUCTURE

RELATED APPLICATIONS

The present application is a U.S. National Phase of International Application Number PCT/CN2018/091933, filed Jun. 20, 2018, and claims the priority of Chinese Application No. 201711135173.4, filed Nov. 16, 2017, and Chinese Application No. 201721529444.X, filed Nov. 16, 2017.

TECHNICAL FIELD

The present invention relates to the field of safety, energy saving and environmental protection integrated engineering technologies of reinforced concrete building structures, and in particular, to a full-cavity concrete slab structure with high integrity and stability and excellent performance, a cavity structure, and a steel bar framework.

BACKGROUND

Recently, the state once again clearly pointed out that construction industry is still a pillar industry in China's economic construction field. Safety, energy saving and environmental protection in construction engineering are the major strategic demands of China. Based on supply side, industry development, and scientific and technological progress requirements, requirements for green, environmental protection, ecology, civilization and environmental friendliness, and requirements for energy saving, low carbon, safety and people's benefits, the State Council recently called on the construction industry to transform and upgrade, improve quality and efficiency, vigorously develop prefabricated buildings, and promote the development of building industrialization and modernization.

Reinforced concrete structure refers to a structure made of concrete reinforced by steel bars, and is one of the main component structures of the building. 80% of the existing building structures are made of reinforced concrete structures, and the main load-bearing components are made of reinforced concrete. Steel bars mainly bear the tension and concrete mainly bears the pressure. This structure has the advantages of sturdiness, durability and good fireproof performance, and saves steels and has lower cost than other structures.

The slab material structure in construction engineering is wide in range, large in quantity, product diversity, diversified in product, and quick in scientific and technological research and technology development. At present, there are mainly masonry slab structures (brick walls) and concrete slab structures, among which there are cast-in-place concrete slab structures that are mostly filled (solid) slab structures, precast concrete walls with hollow (circular hole) battens, precast solid exterior veneer thermal-insulation walls, and precast middle surface embedded interior thermal-insulation boards (such as polystyrene boards and ceramic thermal-insulation boards).

Generally speaking, these wallboard structures have lots of disadvantages and shortcomings, such as, long construction period (such as cast-in-place), complicated construction process (veneering and embedding), high cost, poor energy saving (cold, heat, cracks, and leaks) and environmental protection functions (light and sound pollution, etc.), and poor durability, and has poor actual performance and other practical conditions. Therefore, it is necessary to make breakthrough improvements to the structures, and to innovatively design a full-cavity concrete slab structure with high integrity and stability and excellent performance, a cavity structure, and a steel bar framework to replace the existing structure.

SUMMARY

In order to solve the aforementioned problems, the present invention provides a full-cavity concrete slab structure with high integrity and stability and excellent performance, a cavity structure, and a steel bar framework, to implement high integration of energy saving and environmental protection of structures and buildings. The slab structure not only satisfies the load-bearing resistance requirements of an original wall structure, but also can make the structure safer and more earthquake-resistant and disaster-proof. Namely, the self-safety, self-energy saving, and self-environmental protection of the structure are fully achieved. The slab structure needs neither an exterior veneer and an interior veneer, nor materials such as middle embedded thermal-insulation and fireproof materials, and can be applied as a variety of concrete slab structures for buildings such as interior and exterior walls, floors, roofs, etc., and thus the product has a wide range of applications. In order to achieve this purpose, the present invention provides a full-cavity concrete slab structure with high integrity and stability and excellent performance. The slab type concrete structure is internally provided with a slab type concrete structure unit, where the slab type concrete structure unit includes an external concrete shell, sealed ends, a steel bar framework, and oblique concrete partitions; the external concrete shell is internally provided with rows of the oblique concrete partitions; two adjacent oblique concrete partitions are symmetrically arranged; both ends of the external concrete shell are sealed; two side panels of the external concrete shell form enclosed air cavities together with the corresponding oblique concrete partitions and the sealed ends at the both ends; the air cavities are isosceles or right-angled triangular prismatic cavities; the air cavities are arranged in continuous rows in a staggered manner; the steel bar framework is provided in the external concrete shell and the oblique concrete partitions; the steel bar framework includes horizontal straight bars, vertical steel bars, and horizontal cross-connecting bars; the vertical steel bars are arranged vertically in rows in the two side panels of the external concrete shell, and the vertical steel bars are provided on the ends of edges of the isosceles or right-angled triangular prismatic cavities; rows of the horizontal straight bars are arranged transversely in pairs in the two side panels of the external concrete shell, and the horizontal straight bars are provided on the corresponding inner side or one side provided with the vertical steel bars; each horizontal straight bar corresponds to one horizontal cross-connecting bar; the horizontal cross-connecting bars are of a polyline type, and the horizontal cross-connecting bars connect nodes of the horizontal straight bars and the vertical steel bars passing through a corresponding plane.

As a further improvement of the concrete slab structure of the present invention, the concrete slab structure is an interior-exterior wallboard structure or a floor slab structure or a roof slab structure. The concrete slab structure of the present invention is suitable for use as all of these structures, and therefore, it may be both the wallboard structure and the floor slab structure.

As a further improvement of the concrete slab structure of the present invention, the air cavities are right-angled isosceles triangular prismatic cavities. The cavity structure of the present invention has the best support and stabilization effect when the cross section thereof is a right-angled isosceles triangle.

As a further improvement of the concrete slab structure of the present invention, the concrete slab structure is formed by connecting N slab type concrete structure units side by side, where N is a positive integer; the concrete slab structure is formed by connecting M slab type concrete structure units in the vertical direction, where M is a positive integer. The structure of the present invention is less restrictive, and can be formed by choosing and connecting multiple slab type concrete structure units according to actual situations.

As a further improvement of the concrete slab structure of the present invention, the sealed ends at the upper ends of the air cavities are first sealed ends; the sealed ends at the lower ends of the air cavities are second sealed ends; the first sealed ends are convex pyramid portions, and the second sealed ends are concave pyramid portions; and the concrete structures connected in the vertical direction are connected by engaging the convex pyramid portions with the corresponding concave pyramid portions. The concrete structures that are adjacent in the vertical direction are connected by means of concave and convex pyramids, and the upper end adopts the convex pyramid portion, so as to avoid the entry of water.

The present invention provides a cavity structure for a full-cavity concrete slab structure with high integrity and stability and excellent performance. The cavity structure for a slab type concrete structure includes an external concrete shell, sealed ends, and oblique concrete partitions; the external concrete shell is internally provided with rows of the oblique concrete partitions; two adjacent oblique concrete partitions are symmetrically arranged; both ends of the external concrete shell are sealed; two side panels of the external concrete shell form enclosed air cavities together with corresponding oblique concrete partitions and the sealed ends at the both ends; the air cavities are isosceles or right-angle triangular prismatic cavities; and the air cavities are arranged in continuous rows in a staggered manner.

As a further improvement of the cavity structure for a slab type concrete structure of the present invention, the air cavities are right-angled isosceles triangular prismatic cavities. The cavity structure of the present invention has the best support effect when the cross section thereof is a right-angled isosceles triangle.

The present invention provides a steel bar frameworks for a full-cavity concrete slab structure with high integrity and stability and excellent performance. The steel bar framework is provided in the external concrete shell and the oblique concrete partitions of the full-cavity concrete slab structure with high integrity and stability and excellent performance; the steel bar framework includes horizontal straight bars, vertical steel bars, and horizontal cross-connecting bars; the vertical steel bars are arranged vertically in rows in the two side panels of the external concrete shell, and the vertical steel bars are provided on the ends of edges of the isosceles or right-angled triangular prismatic cavities; rows of the horizontal straight bars are arranged transversely in pairs in the two side panels of the external concrete shell, and the horizontal straight bars are provided on the corresponding inner side or one side provided with the vertical steel bars; each horizontal straight bar corresponds to one horizontal cross-connecting bar; the horizontal cross-connecting bars are of a polyline type, and the horizontal cross-connecting bars connect nodes of the horizontal straight bars and the vertical steel bars passing through a corresponding plane.

According to the full-cavity concrete slab structure with high integrity and stability and excellent performance, the cavity structure, and the steel bar framework, there are cavities in the slab structure of the present invention; the front and rear ends of the cavities are sealed to form enclosed triangular prismatic cavities; the cavities are arranged in continuous rows in a staggered manner; the cross sections of the cavities are right-angled isosceles triangles; reinforcing bars are a double-layer two-way reinforcing mesh; three-dimensional stable reinforcing bars are adopted, which are mainly made of reinforced concrete, and can also be made of various materials such as engineering plastics, resins, and alloys. The concrete may be selected from ordinary concrete, load-bearing concrete such as ceramsite concrete, or special concrete such as waterproof and impervious concrete and fireproof concrete. The mix ratio may be reasonably optimized according to specific functions, and the key part of the concrete is made by means of layered casting. The present invention has the following advantages.

1. Because the present invention adopts a cavity structure, the overall structure is light and can save 30-50% of concrete, and the material saving is relatively obvious.

2. The whole cavity structure of the present invention is a hollow thin-walled triangular tube, and the interior is an air cavity, so the overall structure is stable.

3. The steel bars of the present invention may adopt steel bars for buildings, and the reinforcing bars may be designed according to the rules and regulations based on current and traditional common practices.

4. The reinforcing bars of the present invention are a double-layer reinforcing mesh, adopt three-dimensional stable reinforcing bars, are arranged in a horizontal triangle, are continuously and alternately connected in a staggered manner, and are arranged orderly, to connect each node of the internal and external meshes into an efficient, integrated, stable and consolidated wall. In order to improve the overall strength, each wall may also be equipped with a reinforcing mesh centering cone.

5. The overall structure of the present invention is scientific, ingenious and efficient, and can achieve higher energy saving and environmental protection effects through a single row of holes on the surface and actually two layers of cavities.

6. The outer sides of the sealed ends on both sides of the cavities of the present invention adopt original concave and convex pyramid structures, such structures have good shear and seismic performance, and can prevent water leakage.

7. The present invention has excellent performance and a wide application range, and can be used for all concrete slab structures such as floor slabs and wallboards.

DESCRIPTION OF REFERENCE NUMERALS

1: external concrete shell; 2: cavity; 3: first sealed end; 4: second sealed end; 5: steel bar framework; 51: horizontal straight bar; 52: vertical steel bar; 53: horizontal cross-connecting bar; 6: oblique concrete partition.

DETAILED DESCRIPTION

The present invention is further described in detail below with reference to the accompanying drawings and specific embodiments.

The present invention provides a full-cavity concrete slab structure with high integrity and stability and excellent performance, a cavity structure, and a steel bar framework, to implement high integration of energy saving and environmental protection of structures and buildings. The slab structure not only satisfies the load-bearing resistance requirements of an original wall structure, but also makes the structure safer and more earthquake-resistant and disaster-proof. Namely, the self-safety, self-energy saving, and self-environmental protection of the structure are fully achieved. The slab structure needs neither an exterior veneer and an interior veneer, nor materials such as middle embedded thermal-insulation and fireproof materials, and can be applied as a variety of concrete slab structures for buildings such as interior and exterior walls, floors, roofs, etc., and thus the product has a wide range of applications.

Figure 1:
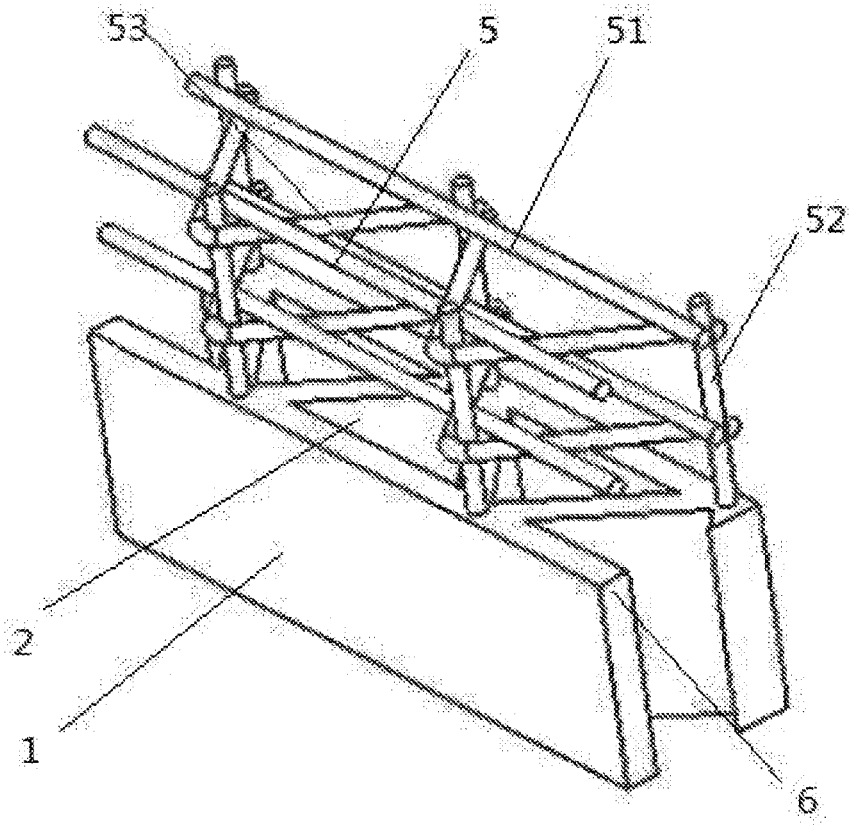
FIG. 1 is a schematic structural diagram of an external concrete structure according to the present invention.

As the simplest embodiment of the concrete slab structure of the present invention, the present invention provides a full-cavity concrete slab structure with high integrity and stability and excellent performance as shown in FIG. 1. The slab type concrete structure is internally provided with a slab type concrete structure unit. The slab type concrete structure unit includes an external concrete shell 1, sealed ends, a steel bar framework 5, and oblique concrete partitions 6. The external concrete shell 1 is internally provided with rows of the oblique concrete partitions 6. Two adjacent oblique concrete partitions 6 are symmetrically arranged. Both ends of the external concrete shell 1 are sealed. Two side panels of the external concrete shell 1 form enclosed air cavities 2 together with the corresponding oblique concrete partitions 6 and the sealed ends at the both ends. The air cavities 2 are isosceles or right-angled triangular prismatic cavities. The air cavities 2 are arranged in continuous rows in a staggered manner. The steel bar framework 5 is provided in the external concrete shell 1 and the oblique concrete partitions 6. The steel bar framework 5 comprises horizontal straight bars 51, vertical steel bars 52, and horizontal cross-connecting bars 53. The vertical steel bars 52 are arranged vertically in rows in the two side panels of the external concrete shell 1, and the vertical steel bars 52 are provided on the ends of edges of the isosceles or right-angled triangular prismatic cavities. Rows of the horizontal straight bars 51 are arranged transversely in pairs in the two side panels of the external concrete shell 1, and the horizontal straight bars 51 are provided on the corresponding inner side or one side provided with the vertical steel bars 52. Each horizontal straight bar 51 corresponds to one horizontal cross-connecting bar 53. The horizontal cross-connecting bars 53 are of a polyline type, and the horizontal cross-connecting bars 53 connect nodes of the horizontal straight bars 51 and the vertical steel bars 52 passing through a corresponding plane.

Figure 2:
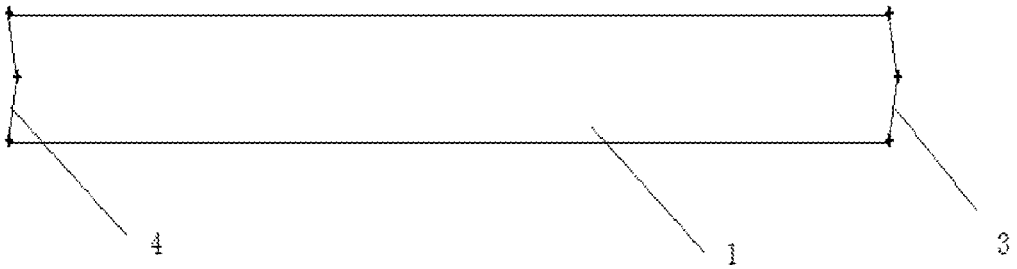
FIG. 2 is a side view of a structure with both ends closed according to the present invention.

As a specific embodiment of the concrete slab structure of the present invention, the present invention provides a full-cavity concrete slab structure with high integrity and stability and excellent performance. The concrete slab structure is an interior-exterior wallboard structure or a floor slab structure or a roof slab structure. The concrete slab structure of the present invention is suitable for use as all of these structures, and therefore, it may be both the wallboard structure and the floor slab structure. The slab type concrete structure is internally provided with a slab type concrete structure unit. The concrete slab structure is formed by connecting N slab type concrete structure units side by side, where N is a positive integer. The concrete slab structure is formed by connecting M slab type concrete structure units in the vertical direction, where M is a positive integer. The structure of the present invention is less restrictive, and can be formed by choosing and connecting multiple slab type concrete structure units according to actual situations. The slab type concrete structure unit includes an external concrete shell 1, sealed ends, a steel bar framework 5, and oblique concrete partitions 6. The external concrete shell 1 is internally provided with rows of the oblique concrete partitions 6. Two adjacent oblique concrete partitions 6 are symmetrically arranged. Both ends of the external concrete shell 1 are sealed. The sealed ends at the upper ends of the air cavities 2 as shown in FIG. 2 are first sealed ends 3; the sealed ends at the lower ends of the air cavities 2 are second sealed ends 4. The first sealed ends 3 are convex pyramid portions, and the second sealed ends 4 are concave pyramid portions. The concrete structures connected in the vertical direction are connected by engaging the convex pyramid portions with the corresponding concave pyramid portions. The concrete structures adjacent in the vertical direction in the present invention are connected by means of concave and convex pyramids, and the upper end adopts the convex pyramid portion, so as to avoid the entry of water. Two side panels of the external concrete shell 1 form enclosed air cavities 2 together with the corresponding oblique concrete partitions 6 and the sealed ends at the both ends. The air cavities 2 are isosceles or right-angled triangular prismatic cavities. The cavity structure of the present invention has the best support and stabilization effect when the cross section thereof is a right-angled isosceles triangle. The air cavities 2 are arranged in continuous rows in a staggered manner. The steel bar framework 5 is provided in the external concrete shell 1 and the oblique concrete partitions 6. The steel bar framework 5 includes horizontal straight bars 51, vertical steel bars 52, and horizontal cross-connecting bars 53. The vertical steel bars 52 are arranged vertically in rows in the two side panels of the external concrete shell 1, and the vertical steel bars 52 are provided on the ends of edges of the isosceles or right-angled triangular prismatic cavities. Rows of the horizontal straight bars 51 are arranged transversely in pairs in the two side panels of the external concrete shell 1, and the horizontal straight bars 51 are provided on the corresponding inner side or one side provided with the vertical steel bars 52. Each horizontal straight bar 51 corresponds to one horizontal cross-connecting bar 53. The horizontal cross-connecting bars 53 are of a polyline type, and the horizontal cross-connecting bars 53 connect nodes of the horizontal straight bars 51 and the vertical steel bars 52 passing through a corresponding plane.

As a specific embodiment of a cavity structure for a slab type concrete structure of the present invention, the cavity structure for a slab type concrete structure includes an external concrete shell 1, sealed ends, and oblique concrete partitions 6. The external concrete shell 1 is internally provided with rows of the oblique concrete partitions 6. Two adjacent oblique concrete partitions 6 are symmetrically arranged. Both ends of the external concrete shell 1 are sealed. Two side panels of the external concrete shell 1 form enclosed air cavities 2 together with the corresponding oblique concrete partitions 6 and the sealed ends at the both ends. The air cavities 2 are isosceles or right-angled triangular prismatic cavities. The air cavities 2 are arranged in continuous rows in a staggered manner.

As a specific embodiment of a steel bar framework for a slab type concrete structure of the present invention, the steel bar framework 5 is provided in an external concrete shell 1 and oblique concrete partitions 6 of the full-cavity concrete slab structure with high integrity and stability and excellent performance. The steel bar framework 5 includes horizontal straight bars 51, vertical steel bars 52, and horizontal cross-connecting bars 53. The vertical steel bars 52 are arranged vertically in rows in the two side panels of the external concrete shell 1, and the vertical steel bars 52 are provided on the ends of edges of the isosceles or right-angled triangular prismatic cavities. Rows of the horizontal straight bars 51 are arranged transversely in pairs in the two side panels of the external concrete shell 1, and the horizontal straight bars 51 are provided on the corresponding inner side or one side provided with the vertical steel bars 52. Each horizontal straight bar 51 corresponds to one horizontal cross-connecting bar 53. The horizontal cross-connecting bars 53 are of a polyline type, and the horizontal cross-connecting bars 53 connect nodes of the horizontal straight bars 51 and the vertical steel bars 52 passing through a corresponding plane.

Figure 3:
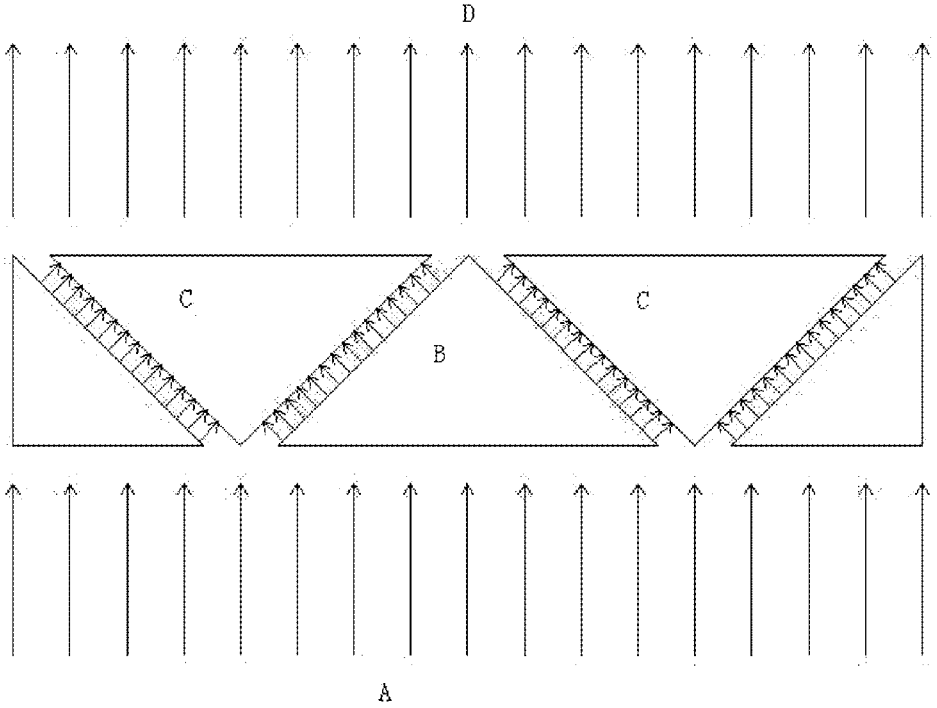
FIG. 3 is a schematic diagram of a heat dissipation method according to the present invention.
Figure 4:
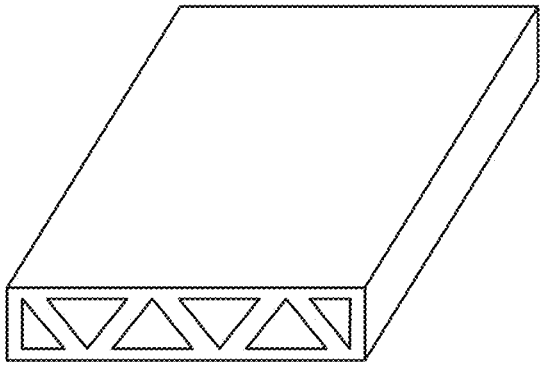
FIG. 4 is a perspective view of an external concrete structure according to the present invention.
Figure 5:
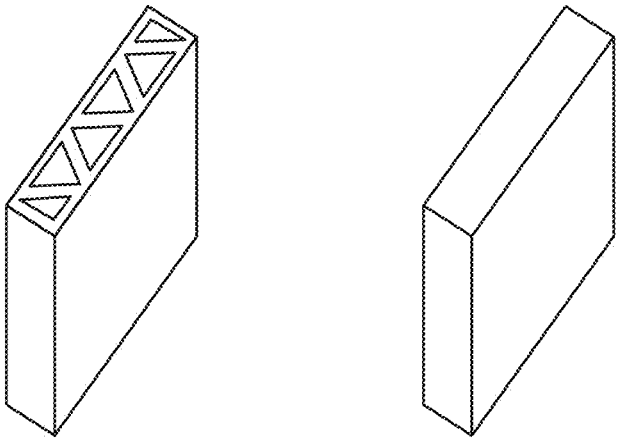
FIG. 5 is perspective views of an external concrete structure according to the present invention.
Figure 6A:
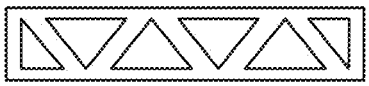
FIG. 6A is a side view of an external concrete structure according to the present invention.
Figure 6B:
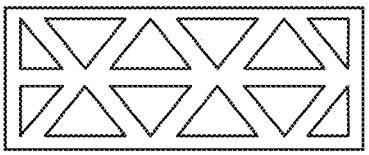
FIG. 6B is a side view of an external concrete structure according to the present invention.
Figure 7A:
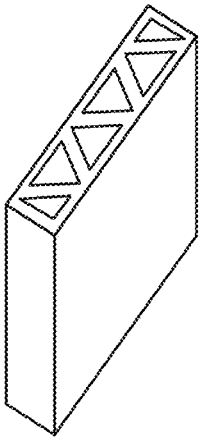
FIG. 7A is a perspective view of an external concrete structure according to the present invention.
Figure 7B:
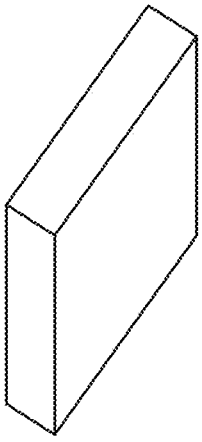
FIG. 7B is a perspective view of an external concrete structure according to the present invention.

The thermal dissipation and sound insulation situations of the present invention are shown in FIG. 3. The A-side area of the slab structure is the outer side, and the D-side area is the inner side. Sound or temperature enters from the A-side area to the D-side area, and first enters the B-cavity area during the entry process. Since the B-cavity area is an isosceles triangle, sound or temperature cannot be discharged after entering, and thus enters the C-cavity area from both sides, and then enters the D-side area. In this way, although there is only a single row of holes, the temperature and sound actually pass through the two layers of cavities, so that noise and temperature are greatly reduced to achieve energy saving, noise reduction and environmental protection effects.

The above descriptions are merely preferred embodiments of the present invention, but are not intended to limit the present invention in any other form. Moreover, any modification or equivalent change made according to the technical essence of the present invention shall still fall within the scope of protection claimed by the present invention.

The invention claimed is:

1. A full-cavity concrete slab structure, being internally provided with a slab type concrete structure unit, wherein the slab type concrete structure unit comprises an external concrete shell, sealed ends, a steel bar framework, and oblique concrete partitions; the external concrete shell is internally provided with rows of the oblique concrete partitions; two adjacent oblique concrete partitions are symmetrically arranged; two ends of the external concrete shell are sealed; two side panels of the external concrete shell form enclosed air cavities together with the corresponding oblique concrete partitions and the sealed ends at the both ends; the air cavities are isosceles or right-angled triangular prismatic cavities; the air cavities are arranged in continuous rows in a staggered manner; the steel bar framework is provided in the external concrete shell and the oblique concrete partitions; the steel bar framework comprises horizontal straight bars, vertical steel bars, and horizontal cross-connecting bars; the vertical steel bars are arranged vertically in rows in the two side panels of the external concrete shell, and the vertical steel bars are provided on the ends of edges of the isosceles or right-angled triangular prismatic cavities; rows of the horizontal straight bars are arranged transversely in pairs in the two side panels of the external concrete shell, and the horizontal straight bars are provided on a corresponding inner side or one side provided with the vertical steel bars; each horizontal straight bar corresponds to one horizontal cross-connecting bar; the horizontal cross-connecting bars are of a polyline type, and the horizontal cross-connecting bars connect nodes of the horizontal straight bars and the vertical steel bars passing through a corresponding plane.

2. The full-cavity concrete slab structure according to claim 1, wherein the concrete slab structure is an interior-exterior wallboard structure or a floor slab structure or a roof slab structure.

3. The full-cavity concrete slab structure according to claim 1, wherein the air cavities are right-angled isosceles triangular prismatic cavities.

4. The full-cavity concrete slab structure according to claim 1, wherein the concrete slab structure is formed by connecting N slab type concrete structure units side by side, wherein N is a positive integer.

5. The full-cavity concrete slab structure according to claim 1, wherein the concrete slab structure is formed by connecting M slab type concrete structure units in the vertical direction, wherein M is a positive integer.

6. The full-cavity concrete slab structure according to claim 5, wherein the sealed ends at upper ends of the air cavities are first sealed ends; the sealed ends at lower ends of the air cavities are second sealed ends; the first sealed ends are convex pyramid portions, and the second sealed ends are concave pyramid portions; the concrete structures connected in the vertical direction are connected by engaging the convex pyramid portions with the corresponding concave pyramid portions.

7. A cavity structure for a full-cavity concrete slab structure, comprising an external concrete shell, sealed ends, and oblique concrete partitions, wherein the external concrete shell is internally provided with rows of the oblique concrete partitions; two adjacent oblique concrete partitions are symmetrically arranged; two ends of the external concrete shell are sealed; two side panels of the external concrete shell form enclosed air cavities together with the corresponding oblique concrete partitions and the sealed ends at the both ends; the air cavities are isosceles or right-angled triangular prismatic cavities; and the air cavities are arranged in continuous rows in a staggered manner.

8. The cavity structure for a full-cavity concrete slab structure according to claim 7, wherein the air cavities are right-angled isosceles triangular prismatic cavities.

9. A steel bar framework for a full-cavity concrete slab structure, the steel bar framework being provided in an external concrete shell and oblique concrete partitions of the full-cavity concrete slab structure, wherein the steel bar framework comprises horizontal straight bars, vertical steel bars, and horizontal cross-connecting bars; the vertical steel bars are arranged vertically in rows in two side panels of the external concrete shell, and the vertical steel bars are provided on the ends of edges of isosceles or right-angled triangular prismatic cavities; rows of the horizontal straight bars are arranged transversely in pairs in the two side panels of the external concrete shell, and the horizontal straight bars are provided on a corresponding inner side or one side provided with the vertical steel bars; each horizontal straight bar corresponds to one horizontal cross-connecting bar; the horizontal cross-connecting bars are of a polyline type, and the horizontal cross-connecting bars connect nodes of the horizontal straight bars and the vertical steel bars passing through a corresponding plane.

* * * * *